US007204884B2

(12) United States Patent
Lunsford et al.

(10) Patent No.: US 7,204,884 B2
(45) Date of Patent: Apr. 17, 2007

(54) LASER MARKING SYSTEM

(75) Inventors: Steven W Lunsford, Elizabethtown, KY (US); Robert Dyrdek, Elizabethtown, KY (US); Charles R Conder, Glendale, KY (US)

(73) Assignee: AGC Automotive Americas Co., Hebron, KY (US)

( * ) Notice: Subject to any disclaimer, the term of this patent is extended or adjusted under 35 U.S.C. 154(b) by 501 days.

(21) Appl. No.: 10/393,559

(22) Filed: Mar. 21, 2003

(65) Prior Publication Data

US 2003/0180475 A1 Sep. 25, 2003

Related U.S. Application Data

(60) Provisional application No. 60/367,018, filed on Mar. 22, 2002.

(51) Int. Cl.
*B05B 5/00* (2006.01)

(52) U.S. Cl. ..... 118/641; 118/642; 118/643

(58) Field of Classification Search ..... 118/641, 118/642, 643; 427/487, 508, 510, 514
See application file for complete search history.

(56) References Cited

U.S. PATENT DOCUMENTS

| | | | |
|---|---|---|---|
| 3,410,203 | A | 11/1968 | Fischbeck |
| 4,148,057 | A | 4/1979 | Jesse |
| 4,150,191 | A | 4/1979 | Karki |
| 4,199,615 | A | 4/1980 | Wacks et al. |
| 4,207,102 | A | 6/1980 | Dessauer |
| 4,232,108 | A | 11/1980 | Dessauer |
| 4,239,789 | A | 12/1980 | Blum et al. |
| 4,323,755 | A | 4/1982 | Nierenberg |
| 4,327,283 | A | 4/1982 | Heyman et al. |
| 4,444,801 | A | 4/1984 | Hongo et al. |
| 4,463,073 | A | 7/1984 | Miyauchi et al. |
| 4,514,456 | A | 4/1985 | Deal et al. |
| 4,515,867 | A | 5/1985 | Bleacher et al. |
| 4,602,263 | A | 7/1986 | Borror et al. |
| 4,621,040 | A | 11/1986 | Viola |
| 4,700,198 | A | 10/1987 | Shirahata et al. |
| 4,716,270 | A | 12/1987 | Gnanamuthu et al. |
| 4,769,310 | A | 9/1988 | Gugger et al. |
| 4,791,267 | A | 12/1988 | Yokoyama et al. |
| 4,838,989 | A | 6/1989 | Ashby et al. |
| 4,844,769 | A | 7/1989 | Kronseder |
| 4,844,947 | A | 7/1989 | Kasner et al. |
| 4,847,138 | A | 7/1989 | Boylan et al. |
| 4,847,181 | A | 7/1989 | Shimokawa |
| 4,857,502 | A | 8/1989 | Ueda et al. |
| 4,861,620 | A | 8/1989 | Azuma et al. |
| 4,882,565 | A | 11/1989 | Gallmeyer |
| 4,898,806 | A | 2/1990 | Pfeifer |
| 4,935,288 | A | 6/1990 | Honaker et al. |
| 4,985,780 | A | 1/1991 | Garnier et al. |
| 4,990,931 | A | 2/1991 | Sato et al. |
| 5,030,551 | A | 7/1991 | Herren et al. |
| 5,035,983 | A | 7/1991 | Kiyonari et al. |
| 5,063,137 | A | 11/1991 | Kiyonari et al. |
| 5,075,195 | A | 12/1991 | Babler et al. |
| 5,116,641 | A | 5/1992 | Patel et al. |
| 5,144,333 | A | 9/1992 | Mizuguchi et al. |
| 5,149,938 | A | 9/1992 | Winston et al. |
| 5,151,572 | A | 9/1992 | Jack |
| 5,206,280 | A | 4/1993 | Williams |
| 5,262,613 | A | 11/1993 | Norris et al. |
| 5,281,449 | A | 1/1994 | Iwasawa et al. |
| 5,348,843 | A | 9/1994 | Beck et al. |
| 5,373,039 | A | 12/1994 | Sakai et al. |
| 5,382,485 | A | 1/1995 | Mizuguchi et al. |
| 5,401,960 | A | 3/1995 | Fisun et al. |
| 5,409,742 | A | 4/1995 | Arfsten et al. |
| 5,413,629 | A | 5/1995 | Yasui et al. |
| 5,422,146 | A | 6/1995 | Adams |
| 5,523,125 | A | 6/1996 | Kennedy et al. |
| 5,592,561 | A | 1/1997 | Moore |
| 5,637,244 | A | 6/1997 | Erokhin |
| 5,653,900 | A | 8/1997 | Clement et al. |
| 5,683,786 | A | 11/1997 | Kavanaugh |
| 5,746,866 | A | 5/1998 | Tanaka et al. |
| 5,753,887 | A | 5/1998 | Rosenwasser et al. |
| 5,757,313 | A | 5/1998 | Meneghini et al. |
| 5,760,367 | A | 6/1998 | Rosenwasser et al. |
| 5,767,483 | A | 6/1998 | Cameron et al. |
| 5,801,356 | A | 9/1998 | Richman |
| 5,817,243 | A | 10/1998 | Shaffer |
| 5,837,609 | A | 11/1998 | Todd et al. |
| 5,837,962 | A | 11/1998 | Overbeck |
| 5,838,361 | A | 11/1998 | Corbett |

(Continued)

FOREIGN PATENT DOCUMENTS

| | | |
|---|---|---|
| EP | 0 202 803 A2 | 11/1986 |
| FR | WO 99/29519 | 6/1999 |
| GB | 2 271 308 A | 4/1994 |
| WO | WO 00/61301 | 10/2000 |
| WO | WO 00/61301 A1 | 10/2000 |

*Primary Examiner*—Bret Chen
(74) *Attorney, Agent, or Firm*—Harness, Dickey & Pierce, P.L.C.

(57) ABSTRACT

A laser marking system for automotive glass having an ink spray device capable of depositing an ink layer upon the glass and a drying system is provided for accelerating the drying of the ink layer. A laser system is also provided to operably heat and bond at least a portion of the ink layer to the glass in a predetermined pattern. A cleansing system removes unbonded portions of the ink layer from the glass and a controller is provided to direct the laser system in the predetermined pattern.

22 Claims, 5 Drawing Sheets

U.S. PATENT DOCUMENTS 5,851,335 A 12/1998 Budnik et al.
5,853,955 A 12/1998 Towfiq
5,855,969 A 1/1999 Robertson
5,866,644 A 2/1999 Mercx et al.
5,897,938 A 4/1999 Shinmoto et al.
5,919,553 A 7/1999 Kavanaugh
5,919,853 A 7/1999 Condit et al.
5,981,136 A 11/1999 Chang et al.
5,985,377 A 11/1999 Corbett
6,007,929 A 12/1999 Robertson et al.
6,028,134 A 2/2000 Zhang et al.
6,037,015 A 3/2000 dos Santo Simoes et al.
6,037,968 A 3/2000 Emge et al.
6,054,192 A 4/2000 Otsuka et al.
6,068,891 A 5/2000 O'Dell et al.
6,075,223 A 6/2000 Harrison
6,108,026 A 8/2000 Corbett
6,113,992 A 9/2000 Corbett
6,127,475 A 10/2000 Vollenberg et al.
6,133,342 A 10/2000 Mizobuchi et al.
6,143,451 A 11/2000 Blanchet-Fincher
6,160,568 A 12/2000 Brodsky et al.
6,177,151 B1 1/2001 Chrisey et al.
6,180,315 B1 1/2001 Schadeli et al.
6,187,213 B1 2/2001 Smith et al.
6,187,390 B1 2/2001 Seeger et al.
6,190,826 B1 2/2001 Chang et al.
6,207,344 B1 3/2001 Ramlow et al.
6,210,472 B1 4/2001 Kwan et al.
6,211,484 B1 4/2001 Kaplan et al.
6,214,916 B1 4/2001 Mercx et al.
6,227,394 B1 5/2001 Shinoda
6,231,196 B1 5/2001 Mahachek
6,238,847 B1 * 5/2001 Axtell et al. ..... 430/322
6,261,348 B1 7/2001 Kwan et al.
6,284,184 B1 9/2001 Choi et al.
6,284,433 B1 9/2001 Ichikawa et al.
6,287,184 B1 9/2001 Carpentier et al.
6,306,493 B1 10/2001 Brownfield
6,313,436 B1 11/2001 Harrison
6,322,958 B1 11/2001 Hayashi
6,333,147 B1 12/2001 Toya
6,335,153 B1 1/2002 Toya
6,338,416 B2 1/2002 Shinoda
6,406,125 B1 * 6/2002 Jackson ..... 347/35
6,485,137 B2 * 11/2002 Karlinski et al. ..... 347/92
6,821,305 B2 * 11/2004 Yan ..... 8/522
6,829,000 B2 * 12/2004 Assa et al. ..... 347/257
2001/0024691 A1 * 9/2001 Kimura et al. ..... 427/346

* cited by examiner

LASER MARKING SYSTEM

CROSS-REFERENCE TO RELATED APPLICATIONS

This application claims the benefit of U.S. Provisional Application No. 60/367,018, filed on Mar. 22, 2002. The disclosure of the above application is incorporated herein by reference.

FIELD OF THE INVENTION

The present invention generally relates to glass manufacturing and, more particularly, relates to laser imprinting indicia on automotive glass.

BACKGROUND OF THE INVENTION

In the automotive industry, government imposed regulations and customer requests often require the application of indicia on automotive glass that identifies the manufacturer of such glass and/or provides additional data. Traditionally, such indicia are applied to the automotive glass using one of a number of different application methods.

One such known application method includes the conventional process of silk screening. During the silk screening process, screen templates are provided that include a film layer, which has been cut to create a design, that is applied to a screen material. This screen template is then positioned over the glass product and ink is forced through the open areas of the film and deposited onto the surface of the glass. The ink deposit must then dry to create a semi-permanent mark. However, silk-screening suffers from a number of disadvantages. For example, the image formed by silk-screening is not quickly and easily changeable during production, thereby preventing the application of discrete symbols on the glass. Moreover, the silk-screens themselves may also become damaged after prolonged exposure to environmental harshness, such as light, water, and the like. Furthermore, the newly formed silk-screened image is especially subject to smearing or damage caused by handling prior to the ink fully curing or drying.

Accordingly, there exists a need in the relevant art to provide a method and apparatus capable of producing indicium on automotive glass that may be immediately handled and resist chipping, flaking, or other damage caused by use or exposure to environmental elements. Still further, there exists a need in the relevant art to provide a method and apparatus capable of overcoming the many disadvantages of the prior art.

SUMMARY OF THE INVENTION

According to the principles of the present invention, a laser marking system for automotive glass is provided having an advantageous construction and method of using the same. According to one embodiment of the present invention, an ink spray device is provide that is capable of depositing an ink layer upon the glass and a drying system is provided for accelerating the drying of the ink layer. A laser system is provided to operably heat and bond at least a portion of the ink layer to the glass in a predetermined pattern. A cleansing system then removes unbonded portions of the ink layer from the glass.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is not intended in any way to limit the invention, its application, or uses.

Referring to the figures, a laser marking system, generally indicated at 10, is illustrated that is capable of applying a permanent indicium 12 (FIG. 8) upon a surface 14 of a sheet of automotive glass 16.

Figure 1:
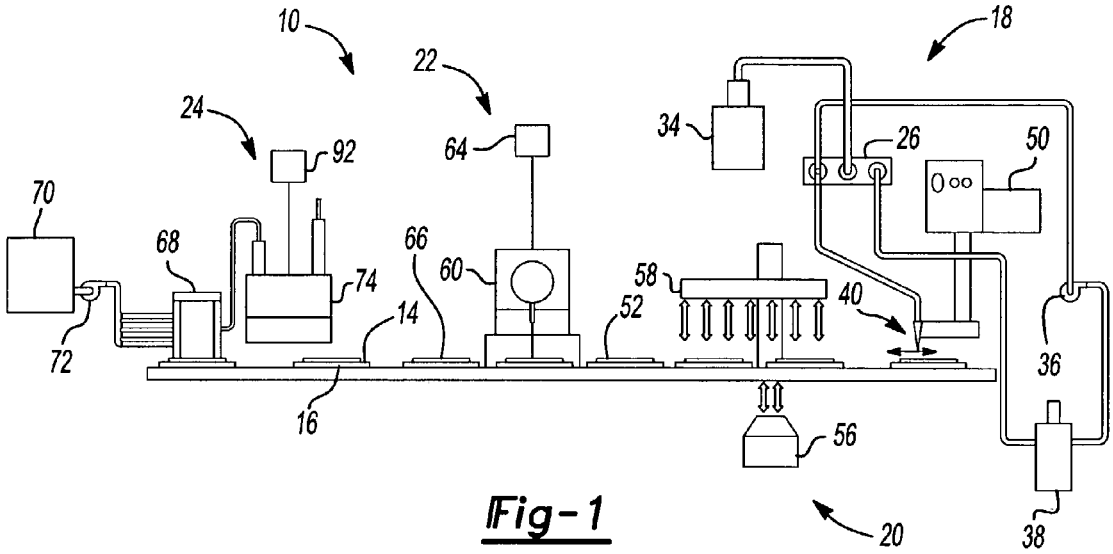
FIG. 1 is a schematic view of a laser marking system according to first embodiment of the present invention.

With particular reference to FIG. 1, laser marking system 10 generally includes an ink spray device 18, a drying system 20, a laser system 22, and a cleaning system 24, which cooperate to permanently apply indicium 12 upon automotive glass 16. It should be appreciated that indicium 12 may be any design or mark and should not be interpreted to be limited to manufacturer data. By way of non-limiting example, indicium 12 may be a logo, bar code, data matrix, trademark, inventory designation, serial number, or the like. However, preferably, indicium 12 may be a design that readily enables a user to distinguish OEM glass from after-market glass. To this end, it should be understood that the quality of indicium 12 of the present invention is sufficient to be readable by a digital scanner or similar device to enable quick and convenient identification of the particular sheet of automotive glass 16.

Figure 2:
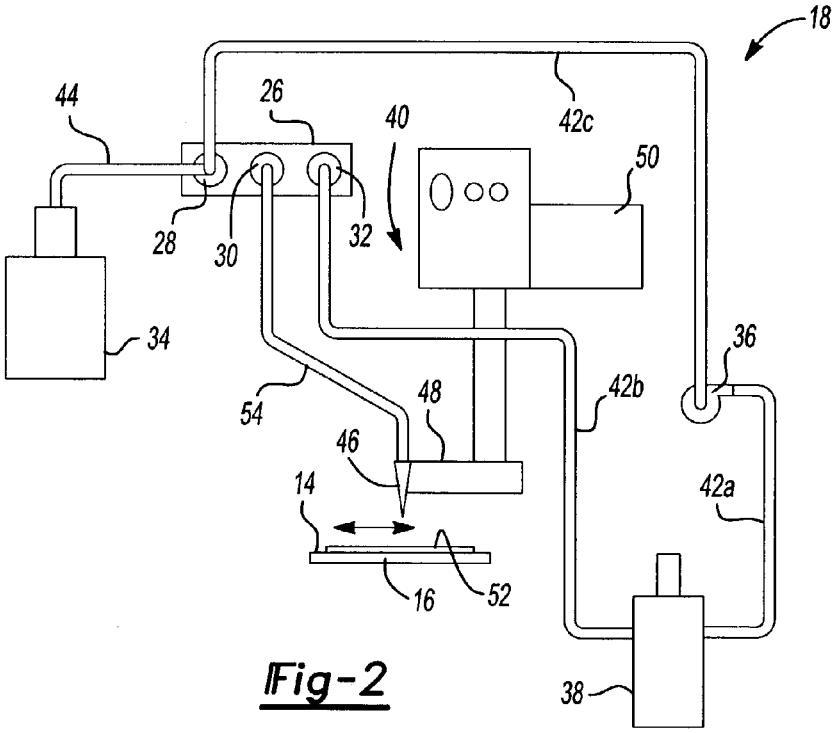
FIG. 2 is a schematic view of an ink spray device used for depositing a uniform ink layer upon automotive glass.

As best seen in FIGS. 1 and 2, ink spray device 18 is provided so as to apply a generally uniform layer of ink upon surface 14 of automotive glass 16. Ink spray device 18 generally includes a manifold 26 having at least three valve members 28, 30, 32 operably disposed therein. Ink spray device 18 further includes a solvent source 34, a fluid pump 36, an ink source 38, and a moveable spray head system 40.

Still referring to FIGS. 1 and 2, manifold 26, fluid pump 36, and ink source 38 are fluidly coupled via line 42 to define a continuous fluid path thereabout. Accordingly, fluid pump 36 is operable to pump continuously the ink through the fluid path—consisting of line 42*a*, ink source 38, line 42*b*, manifold 26, line 42*c*, and fluid pump 36—to prevent or at least minimize the clogging effect caused by the ink remaining stationary in the fluid path. It should be understood that fluid pump 36 may be turned off while ink is being sprayed, since the ink will continue to flow through the lines during this time, thus minimizing any clogging.

Solvent source 34 is fluid coupled to manifold 26 via a line 44. Solvent source 34 preferably comprises a pressure pot that is maintained at a pressure above ambient such that upon actuation of manifold 26, solvent, such as alcohol, is introduced into the fluid path or through manifold 26 to moveable spray head system 40. Solvent source 34 is particularly useful to purge spray head system 40 if an excess amount of time has elapsed from the previous spray application or an excess amount of ink residue has accumulated on spray head system 40.

Spray head system 40 generally includes a spray head 46, a drive mechanism 48, and a spray controller 50. Spray controller 50 controls the ink flow rate and air flowrate that is provided to spray head 46. The air at spray head 46 is atomized and combined with the ink at the output of spray head 46 to create a uniformly distributed spray that is deposited upon surface 14 of automotive glass 16 as an ink layer 52. Drive mechanism 48 supports spray head 46 such that spray head 46 is moved about a predetermined area at a predetermined rate and distance in response to drive commands received from spray controller 50. Spray head 46 is fluidly coupled to manifold 26 via a line 54 to receive solvent from solvent source 34 and/or ink from ink source 38.

Figure 3:
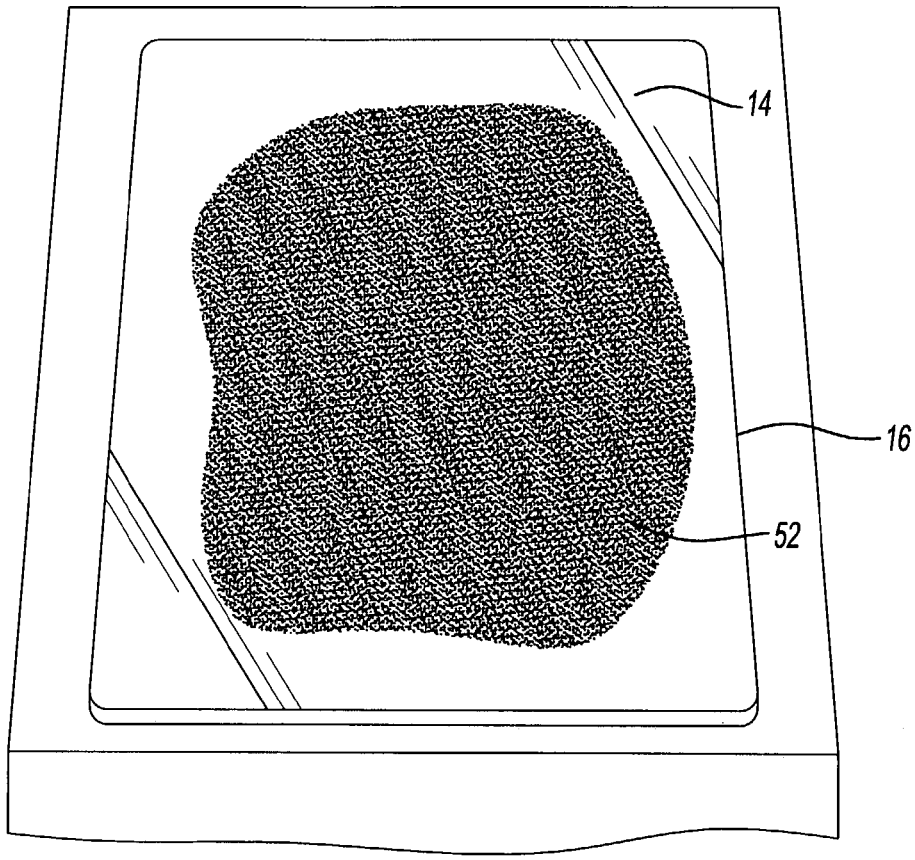
FIG. 3 is a plan view of the ink layer deposited on the automotive glass.

Drive mechanism 48 is preferably an electronically controlled linear bearing system that is capable of smoothly and accurately moving spray head 46 over surface 14 to control the duration, i.e., spray and number of spray passes made during the ink application. It should be understood that the distance of spray head 46 to surface 14, the ink flow rate, the drive rate of drive mechanism 48, and the number of spray passes made will determine the thickness of ink layer 52. The thickness of ink layer 52 is particularly relevant to the quality of laser indicium 12. However, it should be understood that the thickness of ink layer 52 and the particular power capability and exposure time of laser device 22 may all be managed to maximize the durability of indicium 12. That is, it is preferable that sufficient, but not too much, ink is deposited to provide a consistent thickness and coverage pattern of ink upon surface 14 such that laser device 22 is capable of heating and/or molecularly bonding the ink with the glass substrate to effect a permanent, non-fading, crisp indicium or mark. As best seen in FIG. 3, ink layer 52 is preferably uniformly deposited over a targeted area such that the size of ink layer 52 is greater than the area of the final indicium and minimizes any thickness or coverage inconsistencies in ink layer 52 within the targeted area.

Figure 4:
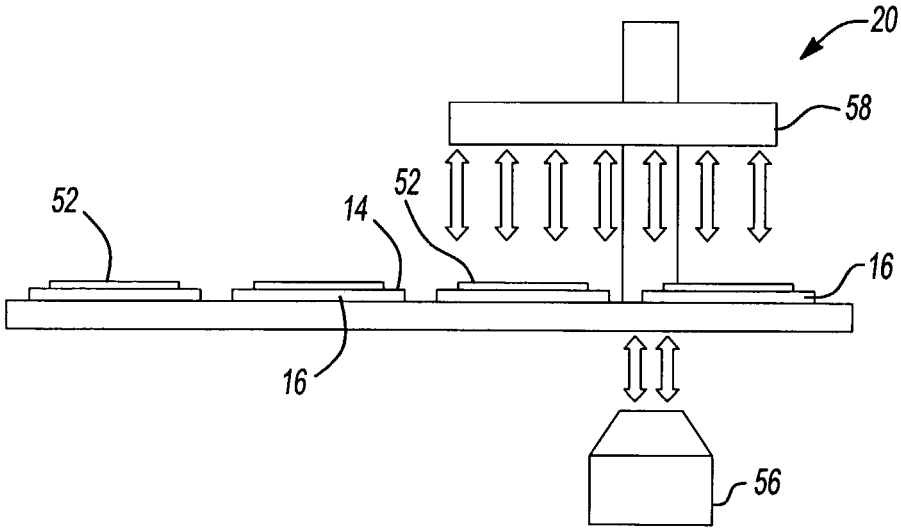
FIG. 4 is a schematic view of a drying system for accelerating the drying of the ink layer following deposition.

Referring now to FIGS. 1 and 4, drying system 20 is provided to facilitate drying of ink layer 52 following ink deposition. Drying system 20 generally includes a heater or electric torch 56 that produces a hot air stream and a low-pressure air source 58 that produces an ambient air stream. Heater 56 is preferably positioned below automotive glass 16, such that it directs the hot air stream generally upward against the underside of automotive glass 16 opposite ink layer 52. That is, heater 56 is directed along the un-sprayed side of automotive glass 16 to warm the underside of the targeted area to indirectly dry ink layer 52. Low-pressure air source 58 blows ambient air along the upper surface of automotive glass 16 to facilitate drying of ink layer 52 and enhance evaporation. It should be noted that it is preferable that the hot air is directed along the underside of automotive glass 16 so as not to dry ink layer 52 too rapidly, which may cause ink layer 52 to develop a dried "skin" along the exposed surface area of the ink. This dried "skin" may otherwise inhibit the further drying of ink that is below the dried "skin", which would prolong the necessary drying time. In this regard, it is preferable that the hot air is blown from the underside to prevent excessively rapid drying of ink layer 52.

Figure 5:
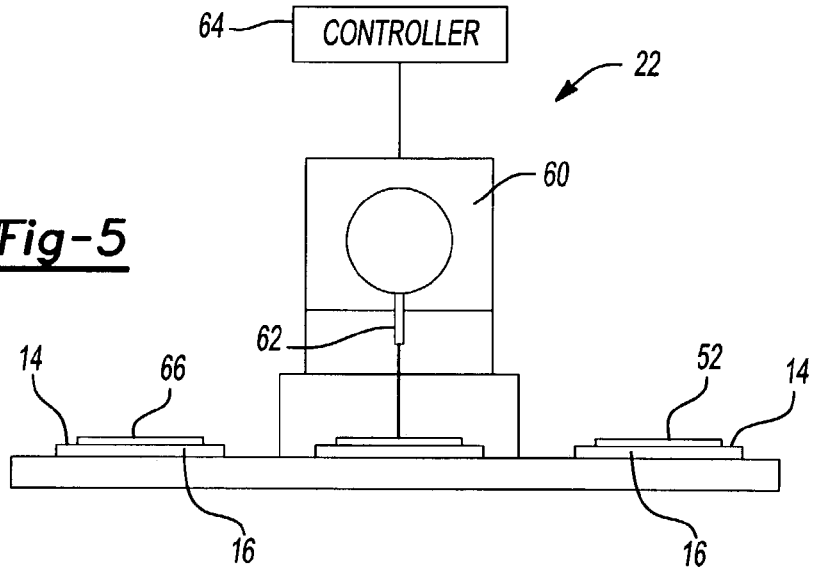
FIG. 5 is a schematic view of a laser system capable of outputting a laser beam directed toward the ink layer.

Referring now to FIGS. 1 and 5, laser system 22 is provided for heating selected portions of ink layer 52 in a predetermined pattern to create indicium 12. The heating of ink layer 52 causes those exposed portions of ink to mechanically bond with automotive glass 16, thereby creating a permanent mechanical bond therebetween. Laser system 22 includes a laser 60 that outputs a laser beam 62 focused upon ink layer 52. Laser 60 is preferably a 30W $CO_2$ laser, which is currently purchased from Front Range Laser. Laser 60 is preferably controllable in response to a laser controller 64, which is capable of actuating laser 60 such that laser beam 62 "draws" a predetermined pattern on ink layer 52. Laser beam 62 is only directed to those portions of ink layer 52 that are to be bonded to automotive glass 16. It should be appreciated that laser controller 64 and laser 60 are capable of creating any one of an infinite number of designs, which may include names, logos, serial numbers, bar codes, data matrices, and the like. It should also be appreciated that laser controller 64 and spray controller 50 may be a single controller, such as a CPU, capable of controlling both processes simultaneously.

Figure 6:
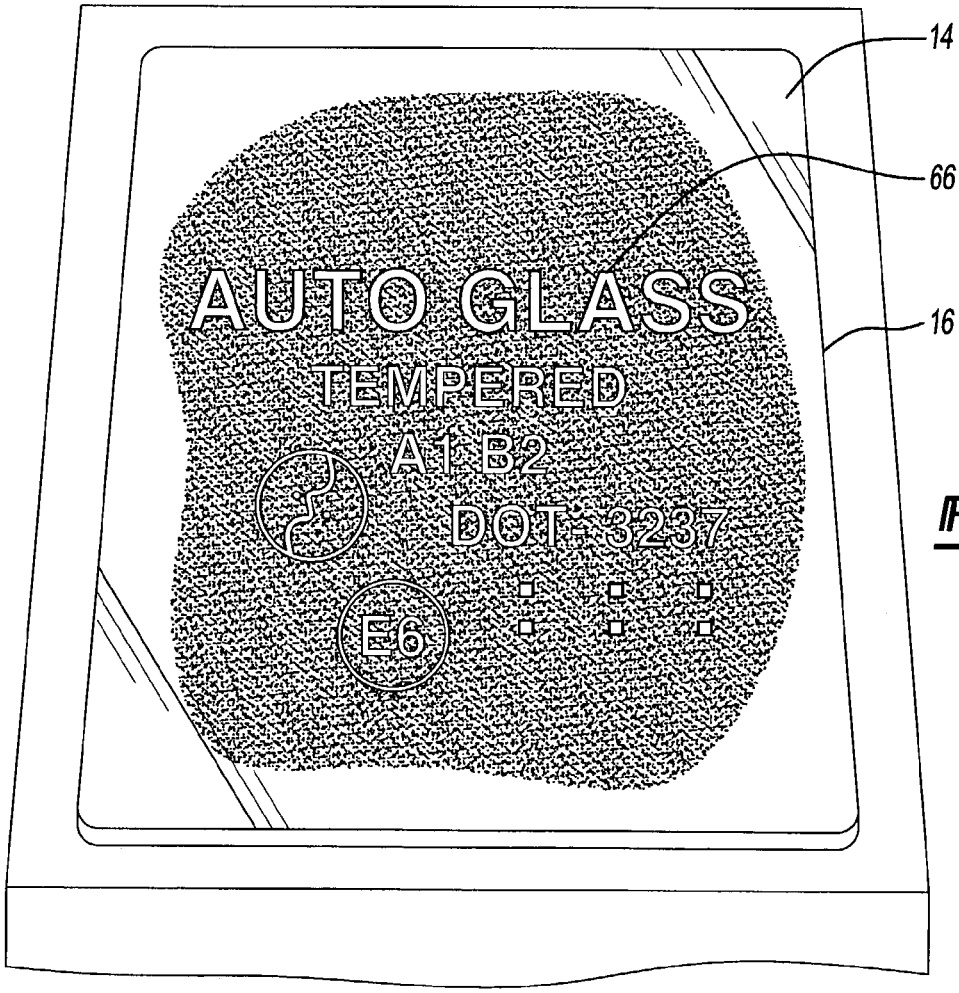
FIG. 6 is a plan view of the ink layer following exposure to the laser beam.

As can be seen in FIG. 6, following application of laser beam 62 to ink layer 52, an initial image 66 is formed on automotive glass 16 as a result of the bonding of the ink with the frit of the glass.

Figure 7:
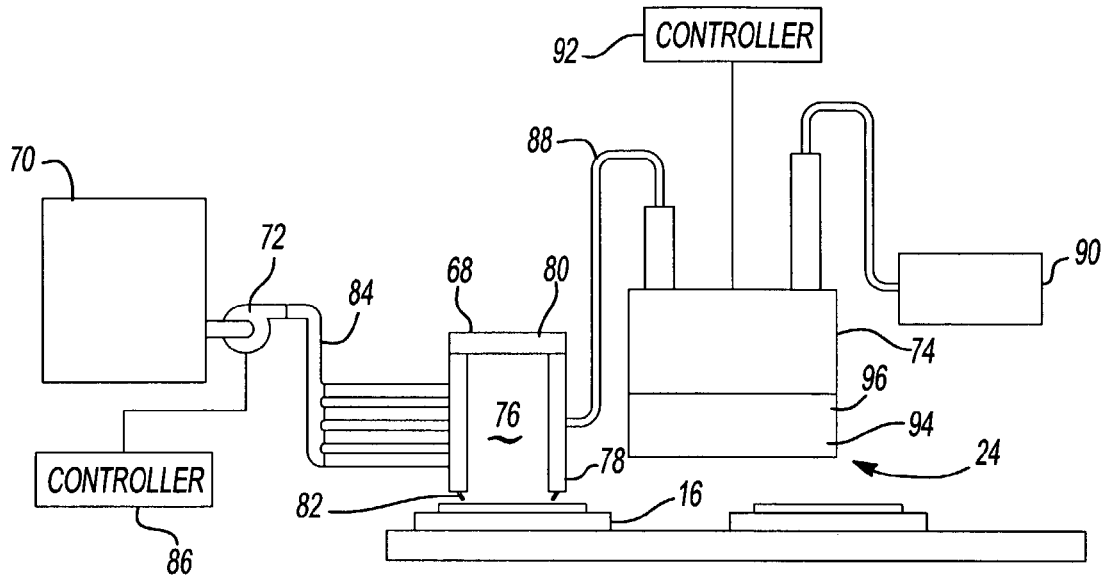
FIG. 7 is a schematic view of a cleansing system capable of removing the unexposed portions of the ink layer.

Following the lasering of ink layer 52, those sections of ink layer 52 that were not exposed to laser beam 62 may be easily removed using any one of a number of methods. As best seen in FIGS. 1 and 7, cleaning system 24 is provided for cleaning and removing those portions of ink layer 52 that were not exposed to laser beam 62 and, thus, were not bonded to automotive glass 16. To this end, cleaning system 24 includes a removal housing 68, a cleansing fluid source 70, a cleansing fluid pump 72, and a vacuum device 74.

Removal housing 68 generally defines a washing or cleansing chamber 76. Although this specific design of removal housing 68 may vary, the exemplary embodiment includes a plurality of sidewalls 78 joined on one end by a cover 80. The opposing end of the plurality of sidewalls 78 may include a sealing member 82 that may be used to engage and seal against automotive glass 16 to define a generally sealed volume. Removal housing 68 is positioned such that image 66 is contained therein.

Cleansing fluid pump 72 is in fluid communication with cleansing chamber 76 via a line 84 and cleansing fluid source 70. Cleansing fluid pump 72 pumps a cleansing fluid, such as water or a solvent, through line 84 into cleansing chamber 76 in response to a control signal from a pump controller 86. Pump controller 86 may be combined with spray controller 50 and laser controller 64 as a single controller. If necessary, this cleansing fluid may be sprayed against automotive glass 16 to aid in the removal of the unexposed portion of ink layer 52 through increased pump pressures. However, the cleansing fluid may simply be pumped into chamber 76 and allowed to flow over and remove the unexposed portion of ink layer 52 under the force of gravity to create an ink/cleansing fluid solution. In the present embodiment, cleansing fluid pump 72 is disposed within cleansing fluid source and, thus, is preferably a submersible pump.

Vacuum device 74 is coupled in fluid communication with cleansing chamber 76 of removal housing 68 via a line 88. Vacuum device 74 is further coupled to a vacuum source 90, such as "shop air," to create a vacuum pressure within vacuum device 74. The vacuum pressure within vacuum device 74 is controllable in response to a control signal from a single system controller or a separate vacuum controller 92. That is, vacuum controller 92 controls a valve (not shown) that selectively establishes fluid communication between vacuum source 90 and line 88, thereby removing the ink/cleansing fluid solution from within chamber 76. This ink/cleansing fluid solution 94 is then trapped within a vacuum chamber 96 for later processing. Preferably, ink/cleansing fluid solution 94 is processed through a separating process to separate the ink from the cleansing fluid. This ink may then be reused within ink spray device 18 and environmental processing costs and disposal of the cleansing fluid may be avoided.

According to an alternative embodiment, ink spray device 18, drying system 20, and cleansing system 24 may be eliminated so as to permit the use of an ink tape rather than a sprayed ink. Specifically, with reference to FIG. 1, laser marking system 10' generally includes a laser system 22, an ink tape system 102 and a removal system 104, which cooperate to permanently apply indicium 12 upon automotive glass 16. Laser system 22, as described above, is provided for heating selected portions of ink in a predetermined pattern to create indicium 12. In the present embodiment, ink is provided via ink tape system 102. Ink tape system 102 generally includes a pair of reels 106 disposed on opposing sides of laser 60. A first of the pair of reels 106 is adapted to carry unused ink tape 108 and the other of the pair of reels 106 is adapted to carry used ink tape 110. Ink tape 108 spans across surface 14 of automotive glass 16 adjacent an area to be marked. Ink tape 108 may be held in this position adjacent the area to be marked using a glass retaining member 112. Ideally, glass retaining member 112 is held in contact with ink tape 108 and, in turn, ink tape 108 is held generally flat and in contact with surface 14 of glass 16.

Laser 60 is actuated to heat selected portions of ink tape 108, which causes those exposed portions of ink tape 108 to mechanically bond with the frit in automotive glass 16, thereby creating a permanent mechanical bond therebetween. Laser beam 62 is only directed to those portions of ink tape 108 that are to be bonded to automotive glass 16. It should be appreciated that laser controller 64 and laser 60 are capable of creating any one of an infinite number of designs, which may include names, logos, serial numbers, bar codes, data matrices, and the like. As each indicium 12 is formed, used ink tape 110 may be advanced, manually or automatically, to provide a "fresh" portion of unused ink tape 108.

Following lasering of ink tape 108 to form indicium 12 upon automotive glass 16, removal system 104 may be employed to remove any excess and/or scrap pieces of ink from surface 14 of automotive glass 16. Removal system 104 is preferably a rotating brush assembly 114, which includes a plurality of brushes 116 that rotate against surface 14 to remove loose and/or unwanted material. However, removal system 104 may be any system that is capable of removing debris, such as pressurized gas, pressurized fluid, and the like. It should be understood that removal system 104 may be used in conjunction with laser marking system 10 and, alternatively, cleansing system 24 may be used in conjunction with laser marking system 10'.

Figure 8:
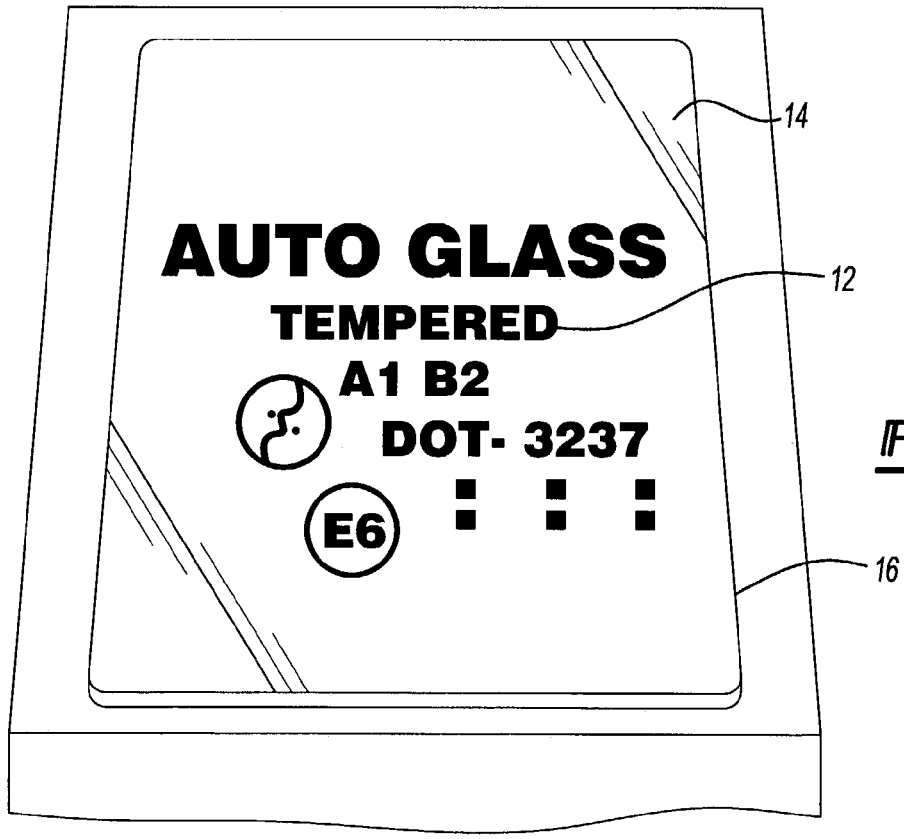
FIG. 8 is a plan view of the automotive glass having a laser formed indicium thereon according to the principles of the present invention.
Figure 9:
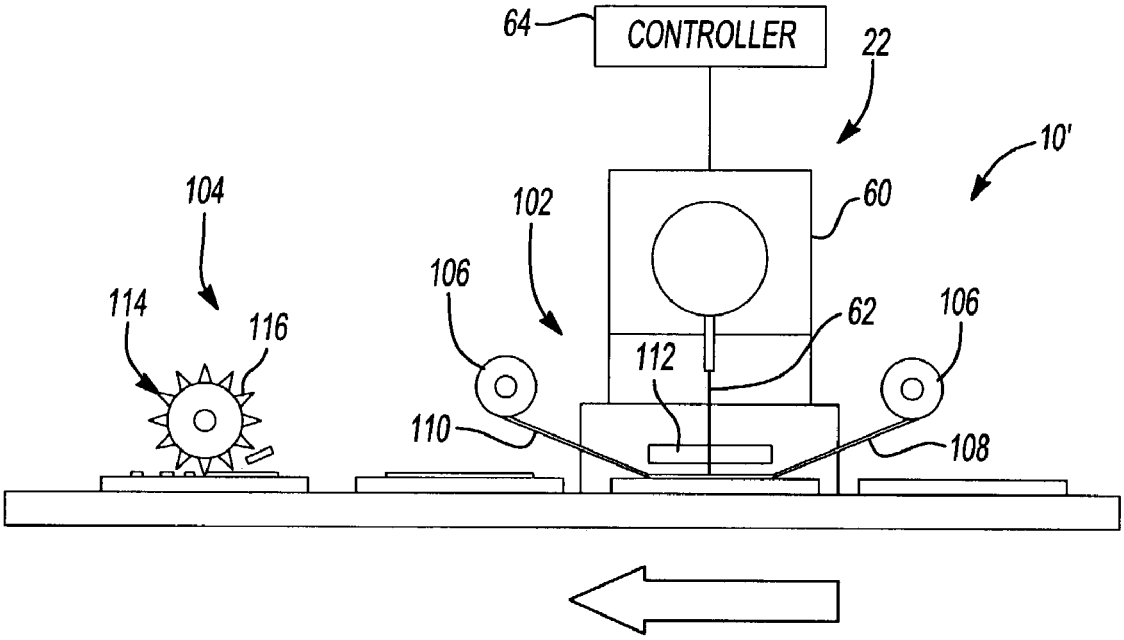
FIG. 9 is a schematic view of a laser marking system according to a second embodiment of the present invention

As best seen in FIG. 8, following removal of the unexposed ink, indicium 12 is now formed on surface 14 of automotive glass 16. Laser marking system 10 provides a number of advantages over known prior art methods including providing a permanent, non-fading, crisp indicium 12 that can be readily scanned or identified by automated means. Moreover, laser marking system 10 of the present invention provides a method and apparatus for applying consistently and uniformly a predetermined thickness of ink upon automotive glass. Still further, laser marking system 10 of the present invention provides a method and apparatus for quickly, conveniently, and reliably drying the ink layer deposited on the glass to facilitate the processing time of the laser marking system. Furthermore, laser marking system 10 of the present invention provides a method and apparatus for quickly and conveniently removing and recycling the unexposed portions of the ink layer.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A laser marking system for glass, the laser marking system comprising:

an ink spray device capable of depositing an ink layer upon the glass, said ink spray device comprises:

a manifold;

a solvent source in fluid communication with the manifold;

a fluid pump in fluid communication with the manifold;

an ink source in fluid communication with the fluid pump, the fluid pump operable to pump ink from the ink source to the manifold; and a moveable spray head in fluid communication with the manifold, the moveable spray head being selectively actuatable to form the ink layer;

a drying system capable of accelerating the drying of the ink layer;

a laser system operable to heat the glass and the ink layer to bond at least a portion of the ink layer to the glass in a predetermined pattern;

a cleansing system operable to remove unbonded portions of the ink layer from the glass; and a controller operably coupled to at least the laser system for directing the laser system in the predetermined pattern.

2. The laser marking system according to claim 1 wherein the solvent source is pressurized above ambient pressure.

3. The laser marking system according to claim 1 wherein the ink source is further in fluid communication with the manifold, the manifold being positionable to define a continuous fluid path from the ink source to the manifold to the fluid pump and back to the ink source.

4. The laser marking system according to claim 3 wherein the fluid pump is activated at least when the moveable spray head is deactuated.

5. The laser marking system according to claim 1 wherein the manifold is positionable to permit solvent from the solvent source to purge the moveable spray head.

6. The laser marking system according to claim 1 wherein the ink spray device includes a moveable spray head operable to form the ink layer.

7. The laser marking system according to claim 1 wherein the ink spray device comprises:

a spray head;

a drive mechanism coupled to the spray head operable to selectively position the spray head relative to the glass;

a spray controller operably coupled to the spray head, the spray controller operable to control an ink flowrate and air flowrate to the spray head to create a generally uniformly distributed spray.

8. The laser marking system according to claim 7 wherein the drive mechanism is an electronically controlled linear bearing system.

9. The laser marking system according to claim 1 wherein the drying system comprises:

a heating device directing heat toward a side of the glass opposite of the ink layer; and a blowing device directing air toward the ink layer to facilitate vaporization.

10. The laser marking system according to claim 1 wherein the cleansing system comprises:

a removal housing positionable to enclose at least a portion of the glass;

a cleansing fluid source in fluid communication with the removal housing;

a fluid pump in fluid communication with the cleansing fluid source, the fluid pump being operable to pump cleansing fluid from the cleansing fluid source to the removal housing to remove excess ink and debris from the glass;

a vacuum device operably coupled to the removal housing, the vacuum device being operable to remove the cleansing fluid and the ink and debris from the removal housing;

a controller operably coupled to at least one of the fluid pump and the vacuum device.

11. The laser marking system according to claim 10, further comprising:

a vacuum chamber in fluid communication with the vacuum device to contain the cleansing fluid, ink, and debris.

12. A laser marking system for glass. the laser markina system comprising:

an ink spray device capable of depositing an ink layer upon the glass, said ink spray device comprises:

a manifold;

a solvent source in fluid communication with the manifold;

a fluid pump in fluid communication with the manifold;

an ink source in fluid communication with the fluid pump, the fluid pump operable to pump ink from the ink source to the manifold; and a moveable spray head in fluid communication with the manifold, the moveable spray head being selectively actuatable to form the ink layer;

a drying system capable of accelerating the drying of the ink layer;

a laser system operable to heat and molecularly bond at least a portion of the ink layer to the glass in a predetermined pattern; and a controller operably coupled to at least the laser system for directing the laser system in the predetermined pattern.

13. The laser marking system according to claim 12 wherein the solvent source is pressurized above ambient pressure.

14. The laser marking system according to claim 13 wherein the manifold is positionable to permit solvent from the solvent source to purge the moveable spray head.

15. The laser marking system according to claim 12 wherein the ink source is further in fluid communication with the manifold, the manifold being positionable to define a continuous fluid path from the ink source to the manifold to the fluid pump and back to the ink source.

16. The laser marking system according to claim 15 wherein the fluid pump is activated at least when the moveable spray head is deactuated.

17. The laser marking system according to claim 12 wherein the ink spray device includes a moveable spray head operable to form the ink layer.

18. The laser marking system according to claim 12 wherein the ink spray device comprises:

a spray head;

a drive mechanism coupled to the spray head operable to selectively position the spray head relative to the glass;

a spray controller operably coupled to the spray head, the spray controller operable to control an ink flowrate and air flowrate to the spray head to create a generally uniformly distributed spray.

19. The laser marking system according to claim 18 wherein the drive mechanism is an electronically controlled linear bearing system.

20. The laser marking system according to claim 12 wherein the drying system comprises:

a heating device directing heat toward a side of the glass opposite of the ink layer; and a blowing device directing air toward the ink layer to facilitate vaporization.

21. The laser marking system according to claim 12 wherein the cleansing system comprises:

a removal housing positionable to enclose at least a portion of the glass;

a cleansing fluid source in fluid communication with the removal housing;

a fluid pump in fluid communication with the cleansing fluid source, the fluid pump being operable to pump cleansing fluid from the cleansing fluid source to the removal housing to remove excess ink and debris from the glass;

a vacuum device operably coupled to the removal housing, the vacuum device being operable to remove the cleansing fluid and the ink and debris from the removal housing;

a controller operably coupled to at least one of the fluid pump and the vacuum device.

22. The laser marking system according to claim 21, further comprising:

a vacuum chamber in fluid communication with the vacuum device to contain the cleansing fluid, ink, and debris.

* * * * *